US007145296B2

(12) United States Patent
Wang et al.

(10) Patent No.: US 7,145,296 B2
(45) Date of Patent: Dec. 5, 2006

(54) PROGRAMMABLE DRIVING METHOD FOR LIGHT EMITTING DIODE

(75) Inventors: Ming-Kung Wang, Hsinchu County (TW); Shih-Ting Chang, Taoyuan (TW); De-Shin Yang, Taipei (TW)

(73) Assignee: Holtek Seminconductor Inc., Hsinchu (TW)

( * ) Notice: Subject to any disclaimer, the term of this patent is extended or adjusted under 35 U.S.C. 154(b) by 116 days.

(21) Appl. No.: 11/052,888

(22) Filed: Feb. 9, 2005

(65) Prior Publication Data

US 2006/0119296 A1 Jun. 8, 2006

(30) Foreign Application Priority Data

Dec. 6, 2004 (TW) ..... 93137571 A

(51) Int. Cl.
*H05B 37/02* (2006.01)

(52) U.S. Cl. ..... 315/360; 315/169.3; 345/76; 345/82

(58) Field of Classification Search ..... 315/360, 315/169.1–169; 345/39, 45, 46, 76, 82, 90
See application file for complete search history.

(56) References Cited

U.S. PATENT DOCUMENTS

| | | | | |
|---|---|---|---|---|
| 3,982,239 | A * | 9/1976 | Sherr | 345/45 |
| 6,366,116 | B1 | 4/2002 | Juang | 326/37 |
| 6,501,226 | B1 | 12/2002 | Lai et al. | 315/169.1 |
| 2004/0246248 | A1 * | 12/2004 | Tsai et al. | 345/211 |
| 2004/0257315 | A1 | 12/2004 | Wang et al. | 345/82 |
| 2005/0017930 | A1 * | 1/2005 | Kobayashi et al. | 345/76 |

* cited by examiner

*Primary Examiner*—Trinh Vo Dinh
(74) *Attorney, Agent, or Firm*—Troxell Law Office, PLLC

(57) ABSTRACT

A programmable driving method for light emitting diode is disclosed, which is capable of providing a programmable multi-phase segment and a corresponding programmable multi-phase actuating signal to an LED with respect to user specification, such that an optimal driving sequence can be provided to the LED according to the requirements of the manufacturing process of a LED display and thus enabling the performance of the gray levels displayed by the LED display to be optimized.

17 Claims, 9 Drawing Sheets

| SP1 | SP2 | SP3 | SP4 | SP5 |
|---|---|---|---|---|

SP1=

| | | | | | | | |
|---|---|---|---|---|---|---|---|
| 0 | 0 | 0 | 0 | 0 | 1 | 0 | 1 |

SP2=

| | | | | | | | |
|---|---|---|---|---|---|---|---|
| 0 | 1 | 0 | 0 | 1 | 0 | 0 | 0 |

SP3=

| | | | | | | | |
|---|---|---|---|---|---|---|---|
| 1 | 0 | 1 | 1 | 1 | 1 | 1 | 1 |

SP4=

| | | | | | | | |
|---|---|---|---|---|---|---|---|
| 0 | 0 | 0 | 0 | 0 | 0 | 0 | 1 |

SP5=

| | | | | | | | |
|---|---|---|---|---|---|---|---|
| 1 | 1 | 0 | 0 | 0 | 0 | 0 | 1 |

D:Dis-Charge P:Pre-Charge C:Current Driving

| SP1 | SP2 | SP3 | SP4 | SP5 |
|---|---|---|---|---|

SP1=

| | | | | | | | |
|---|---|---|---|---|---|---|---|
| 0 | 0 | 0 | 0 | 0 | 1 | 0 | 1 |

SP2=

| | | | | | | | |
|---|---|---|---|---|---|---|---|
| 0 | 1 | 0 | 0 | 1 | 0 | 0 | 0 |

SP3=

| | | | | | | | |
|---|---|---|---|---|---|---|---|
| 1 | 0 | 1 | 1 | 1 | 1 | 1 | 1 |

SP4=

| | | | | | | | |
|---|---|---|---|---|---|---|---|
| 0 | 0 | 0 | 0 | 0 | 0 | 0 | 1 |

SP5=

| | | | | | | | |
|---|---|---|---|---|---|---|---|
| 1 | 1 | 0 | 0 | 0 | 0 | 0 | 1 |

RP1=

| | | | | | | | |
|---|---|---|---|---|---|---|---|
| 0 | 0 | 0 | 0 | 0 | 1 | 0 | 1 |

RP2=

| | | | | | | | |
|---|---|---|---|---|---|---|---|
| 0 | 0 | 0 | 0 | 1 | 0 | 0 | 0 |

RP3=

| | | | | | | | |
|---|---|---|---|---|---|---|---|
| 0 | 0 | 1 | 1 | 1 | 1 | 1 | 1 |

RP4=

| | | | | | | | |
|---|---|---|---|---|---|---|---|
| 0 | 0 | 0 | 0 | 0 | 0 | 0 | 1 |

RP5=

| | | | | | | | |
|---|---|---|---|---|---|---|---|
| 0 | 1 | 0 | 0 | 0 | 0 | 0 | 1 |

FIG. 7

RP1=

| | | | | | | | |
|---|---|---|---|---|---|---|---|
| 1 | 0 | 0 | 0 | 0 | 1 | 0 | 1 |

RP2=

| | | | | | | | |
|---|---|---|---|---|---|---|---|
| 1 | 0 | 0 | 0 | 1 | 0 | 0 | 0 |

RP3=

| | | | | | | | |
|---|---|---|---|---|---|---|---|
| 0 | 1 | 1 | 1 | 1 | 1 | 1 | 1 |

RP4=

| | | | | | | | |
|---|---|---|---|---|---|---|---|
| 1 | 0 | 0 | 0 | 0 | 0 | 0 | 1 |

RP5=

| | | | | | | | |
|---|---|---|---|---|---|---|---|
| 1 | 0 | 0 | 0 | 0 | 0 | 0 | 1 |

FIG. 8

PROGRAMMABLE DRIVING METHOD FOR LIGHT EMITTING DIODE

FIELD OF THE INVENTION

The present invention relates to a method for driving light emitting diode (LED), and more particularly, to a programmable driving method for LEDs.

BACKGROUND OF THE INVENTION

An organic light emitting diode (OLED) is an electronic device made by placing a series of organic thin films between two conductors. When electrical current is applied, a bright light is emitted. This process is called electrophosphorescence. When used to produce displays, OLED technology produces self-luminous displays that do not require backlighting. These properties result in thin, very compact displays. In addition, the displays also have a wide viewing angle, up to 160 degrees and require very little power, only 2–10 volts.

Please refer to FIG. 1, which is a schematic view of an organic light emitting diode. As seen in FIG. 1, the OLED 100 is an electronic device that sandwiches carbon-based films between two charged electrodes, one a metallic cathode 130 and one a transparent anode, usually being made of indium tin oxide (ITO) and connecting to the anode of a power source 120. The organic films consist of a hole-transport layer (HTL) 140, an emissive layer (EL) 150 and an electron-transport layer (ETL) 160. When voltage is applied to the OLED cell by the power source 120, the injected positive and negative charges recombine in the emissive layer 150 and create electro luminescent light. Furthermore, since the material used in the manufacturing of the OLED 100 determines the color of the formed visible light, the requirement of the full-color display can be easily achieved.

Generally, it is common to drive an OLED display by using the row scan technology, which applies the three-phase driving method. Please refer to FIG. 2A, which is a schematic diagram showing only three OLED circuits within one column of the whole OLED array. In which, the three OLED circuits 210, 220 and 230, each composed of an OLED 240 and a capacitor 250 and being arranged respectively at Row 1, Row 2, and Row3, are subjected to the same segment S. In addition, for each row of the OLEDs, two kinds of operating phases are provided: a. Current sinker phase, the current is sunk into the OLEDs successfully. b. Reverse bias phase, the object is to increase the durations of the OLEDs, and for each column of the OLEDs, each segment of the OLEDs is driven by a constant current source (not shown) where each segment of the OLEDs is driven by the following three-phase driving method: a. Dis-charge phase, the retaining electric charges of the OLEDs are discharged. b. Pre-charge phase, the potentials of the OLEDs are precharged to the initial potentials for performing the best electrifying efficiency when current is sunk in. c. Current driving phase, the current is sunk into the OLEDs to make it to luminesce.

As seen in FIG. 2A, the segment S of the OLEDs is driven by a constant current/voltage source according to the three-phase driving method, so that the OLED 240 for example is activated to emit light while the potential stored in the capacitor 240 had reached the initial potential of the OLED 240.

Refer to FIG. 2B, which is a schematic diagram depicting the application of the three-phase driving method of the OLEDs of FIG. 2A. During the period of activating the OLED 240 of Row 1 from inactive to luminous in the segment S, the capacitor 250 is subjecting to three different potentials provided by a power source with respect to the three-phase driving method. That is, when the discharge phase initiates, the retaining electric charge of the capacitor 250 is discharged as the OLED 240 of Row 1 is in the current sinker phase activated by an actuating signal; when the pre-charge phase initiates, the capacitor 250 is subjected to a pre-charge potential provide by the power source as the OLED 240 of Row 1 is still in the current sinker phase; and eventually when the current driving phase initiates, the potential of the capacitor 250 reaches the initial potential of the OLED 240 and the current is sunk into the OLED 240 to make it to luminesce as the OLED 240 of Row 1 is still in the current sinker phase.

Accordingly, both the OLED circuit 220 of Row 2 and 230 and OLED circuit 230 of Row 3 can be activate to luminesce by means of the above cyclic charging and discharging processes.

However, within the segment S, the conventional three-phase method for driving OLEDs can only moderately adjust the cycle and the potential of the pre-charge phase, and can not modify the same of the other two phases according to the characteristics of the OLED display with respect to the process of manufacturing the same. That is, the potentials provided by the conventional three-phase method can be adjusted effectively in accordance to the various characteristics of different OLED displays.

Please refer to FIG. 3, which is a schematic diagram showing the idea and prior-art potentials provided by the conventional three-phase method. As seen in FIG. 3, under the idea condition, the potential of an OLED is abruptly being raised to an initial potential thereof after it is pre-charged by the pre-charge phase. However, under a condition of prior-art, owing to the conventional pre-charge phase and the current driving phase are not adjustable with respect to the various characteristics of different OLED displays, therefore, while applying the conventional three-phase method for driving an OLED display with excessive loading, the period of current driving phase will be cut short or the potential of the current driving phase will be too low accordingly such that the response of the OLED display along with the gray levels thereof will be affected.

Therefore, it is required to have a driving method for LEDs capable of being programmed with respect to various characteristics of different LED displays for enabling the LED to have optimum response time and gray level representation.

SUMMARY OF THE INVENTION

It is the primary object of the invention to provide a driving method for LEDs capable of being programmed with respect to various characteristics of different LED displays.

To achieve the above object, the present invention provides a programmable driving method for LEDs, the method comprising the steps of: providing potentials of at least three phases with in a segment to a control circuit for controlling the luminescence of an LED; making an evaluation for selecting an operating mode out of at least three operating modes for each driving phase with respect to the physical characteristics of the LED.

Correspondingly, for each row of the OLEDs, an actuating signal of at least three phases is provided, wherein an evaluation can be made for selecting an operating mode out of at least three operating modes for each phase with respect to the physical characteristics of the LED.

In a preferred embodiment of the invention, a five-phase method for driving LEDs are provided that the operating mode of each phase is selected from the group consisting of dis-charge mode, pre-charge mode, current driving mode, and floating mode.

Moreover, corresponding to the foregoing five-phase driving method, the actuating signal of five phases is provided, in which the operating mode of each phase is selected from the group consisting of current sink mode and reverse bias mode.

BRIEF DESCRIPTION OF THE DRAWINGS

FIG. 7 is a schematic diagram depicting the application of using five registers for defining the five phases of the actuating signal for an active LED of FIG. 4.

FIG. 8 is a schematic diagram depicting the application of using five registers for defining the five phases of the actuating signal for a non-active LED of FIG. 4.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

Figure 4:
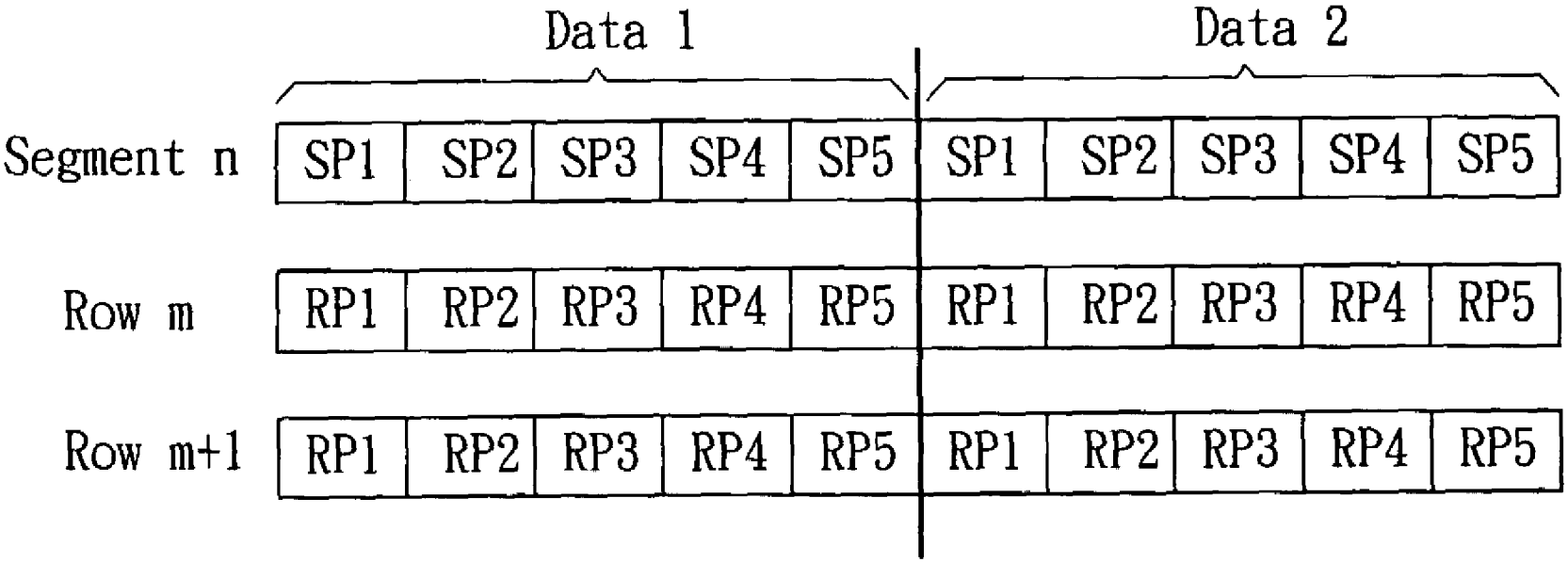
FIG. 4 is a schematic diagram depicting the application of a five-phase driving method on LEDs according to a preferred embodiment of the present invention.

Please refer to FIG. 4, which is a schematic diagram depicting the application of a five-phase driving method on LEDs according to a preferred embodiment of the present invention. In order to improve the conventional three-phase driving method, the present invention provides a method capable of driving an LED by a programmable multi-phase segment and a corresponding programmable multi-phase actuating signal to an LED, which are programmed with respect to the requirements of the manufacturing process of a LED display.

Thus, as the period of data 1 of a preferred embodiment shown in FIG. 4, potentials of five phases are provided to an LED within a segment, which are SP1, SP2, SP3, SP4 and SP5, and moreover, the actuating signal of each row of LED corresponding to the segment is also being divided into five phases, which are RP1, RP2, RP3, RP4 and RP5.

Wherein, each phase of the segment has an operating mode selected out of four operating mode, which are a dis-charge mode, a pre-charge mode, a current driving mode, and a floating mode, and moreover, each phase of the actuating signal has an operating mode selected out of three operating mode, which are a dis-charge mode, a reverse bias mode and a floating mode.

Since each phase of the segment and the actuating signal is programmable, it is noted that the operating mode as well as the duration of each phase can be defined by user according to specified requirement. In a preferred embodiment of the invention, a set of 16-bit register can be used for defining the operating mode and the duration for each phase.

For example, Bit[10:8] is used for specifying a phase out of the SP1~SP5, Bit[7:6] is used for specifying an operating mode for the specified phase, and Bit[5:0] is used for defining the duration of the specified operating mode, where the 6 bits of the Bit[5:0] can be used for specifying system clocks of 0 clk to 63 clk.

Figures 5, 6:
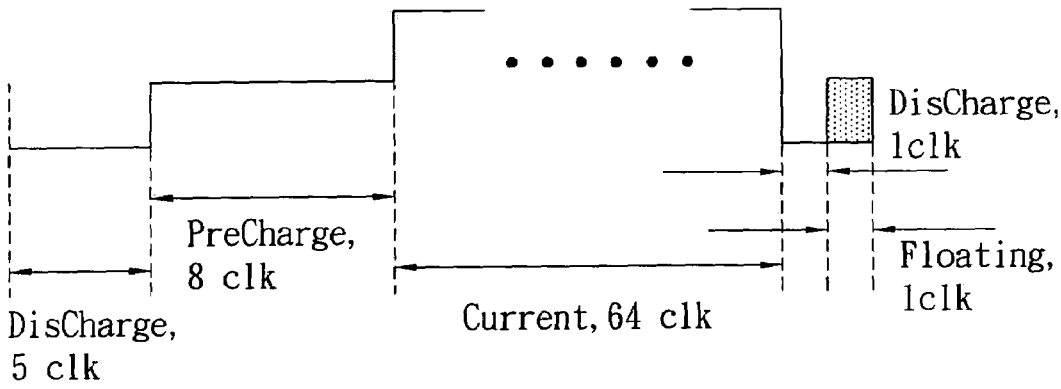
FIG. 5 is a schematic diagram depicting the application of using five registers for defining potentials of the five phases of the segment of FIG. 4.
FIG. 6 is a schematic diagram showing the variation of waveform with respect to the five phases of a segment according to the preferred embodiment of the invention.

Please refer to FIG. 5, which is a schematic diagram depicting the application of using five registers for defining potentials of the five phases of the segment of FIG. 4. As seen in FIG. 5, five 8-bit registers are used for defining the five phase in respective, and is arranged for representing the Bit[7:6] and the Bit[5:0] of the above 16-bit register in sequence, wherein:

Bit[7:6] = 0,0 = Dis-charge

= 0,1 = Pre-charge

= 1,0 = Current driving

= 1,1 = Floating

Such that the operating modes and the duration thereof can be defined respectively for the five phases of the segment by the use of the five registers. Referring to FIG. 6 for the waveform with respect to the five phases of a segment according to the preferred embodiment of FIG. 5. As seen in FIG. 6, the five phases driving the LED are a dis-charge mode of 5 system clocks, a pre-charge mode of 8 system clocks, a current driving mode of 64 system clocks, a dis-charge mode of 1 system clock and a floating mode of 1 system clock.

In addition, corresponding to the potentials of five phases seen in FIG. 5, the actuating signal can be divided into a plurality of phases of different operating modes according to the LED being in active region or in non-active region.

Please refer to FIG. 7, which is a schematic diagram depicting the application of using five registers for defining the five, phases of the actuating signal for an active LED of FIG. 4. Similarly, as seen in FIG. 7, five 8-bit registers are used for defining the five phase, i.e. RP1~RP5, in respective, and is arranged for representing the Bit[7:6] and the Bit[5:0] of the above 16-bit register in sequence, wherein:

Bit[7:6] = 0,0 = Current driving

= 0,1 = Reverse bias

= 1,0 = Floating

Please refer to FIG. 7, which is a schematic diagram depicting the application of using five registers for defining the five phases of the actuating signal for a non-active LED of FIG. 4. Similarly, as seen in FIG. 8, five 8-bit registers are used for defining the five phase, i.e. RP1~RP5, in respective, and is arranged for representing the Bit[7:6] and the Bit[5:0] of the above 16-bit register in sequence. The difference between the active LED of FIG. 7 and the non-active LED of FIG. 8 is that the operating mode for each phase of the active LED is set to be different from that of the corresponding phase of the non-active LED.

Figure 9:
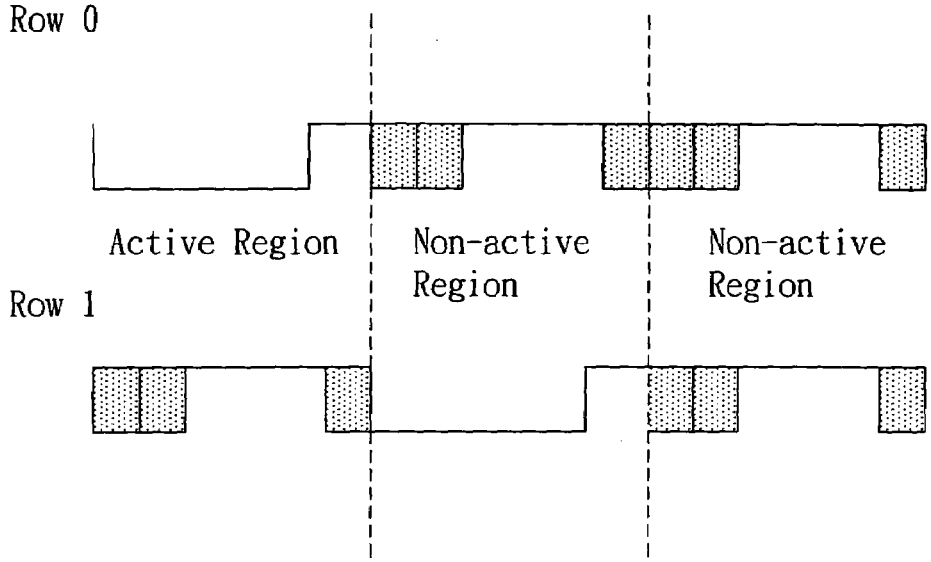
FIG. 9 is a schematic diagram showing the variation of waveform with respect to the five phases of an actuating signal according to the preferred embodiment of the invention.

As the waveform of the actuating signal according to a preferred embodiment of the invention shown in FIG. 9, the actuating signal is acting on the LED of Row 0 while the status of the LED of Row 0 progress from active region, non-active region, and finally back to active region, where the actuating signal can be divided into five phases, i.e. RP1~RP5, in each region. The five phases of the actuating signal driving the LED of Row 0 while the LED of Row 0 is in active region are successively a current driving mode of 6 system clocks (RP1), a current driving mode of 9 system clocks (RP2), a current driving mode of 64 system clocks (RP3), a current driving mode of 1 system clock (RP4) and a reverse bias mode of 1 system clock (RP5).

Similarly, the operating modes of the five-phase actuating signals acting on the LED of Row 1 can be seen in FIG. 9 that also is programmed to have different operating modes and duration thereof with respect to the status of the LED of Row 1.

From the above description, it is noted that both the segment of multiple phases and the actuating signal of multiple phases are programmable. Therefore, it is possible to define and adjust the operating mode and the duration thereof for each phase of the segment and the actuating signal with respect to the requirement of a specified LED display such that it is capable of increasing the driving efficiency of the LED display since the response times of LEDs are bettered.

Furthermore, an over driving phase of short duration can be added before each phase of current driving mode within a segment so as to improve the performance of the gray level displayed by the LED display.

Figure 1:
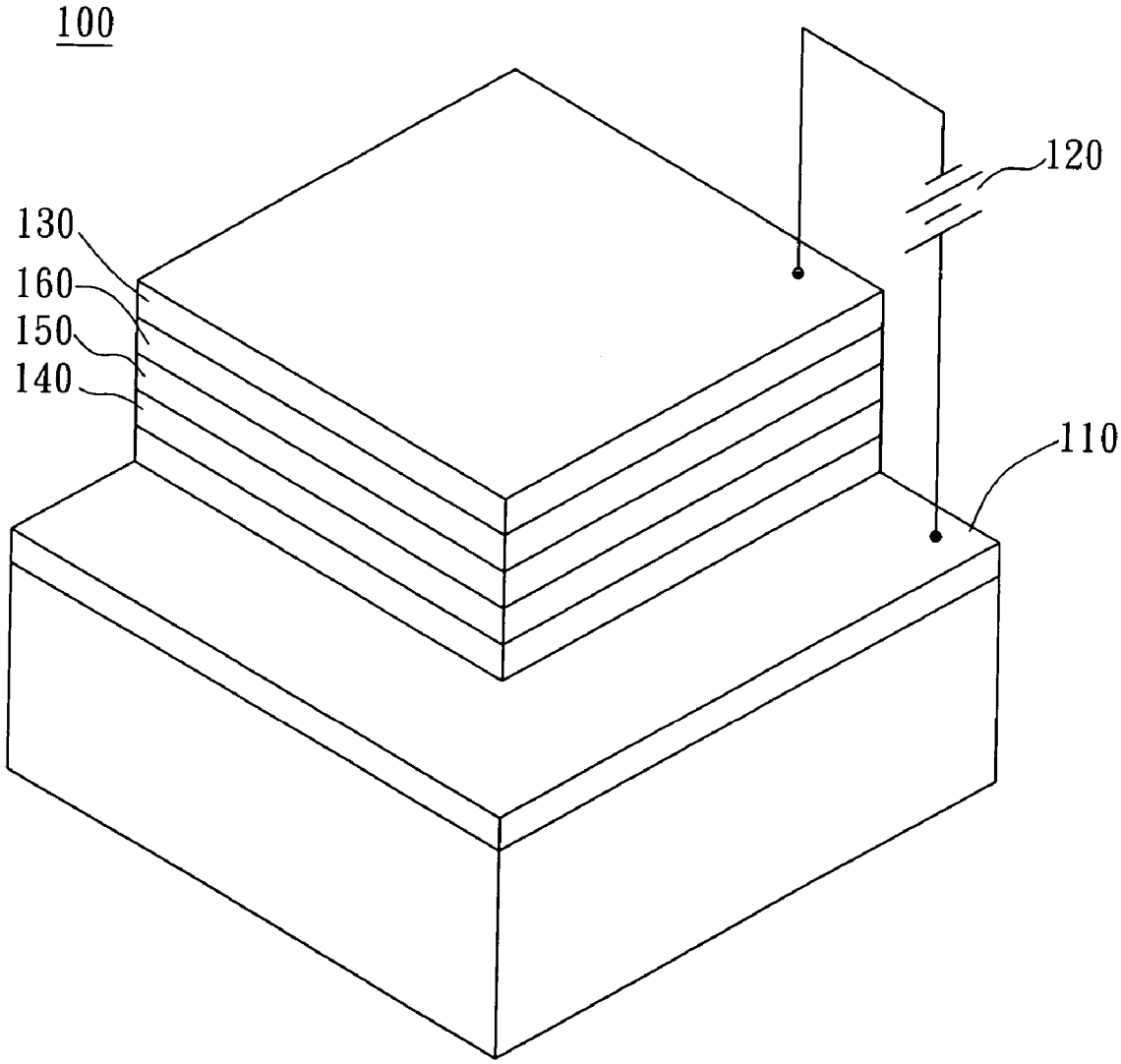
FIG. 1 is which is a schematic view of an organic light emitting diode.
Figure 2A:
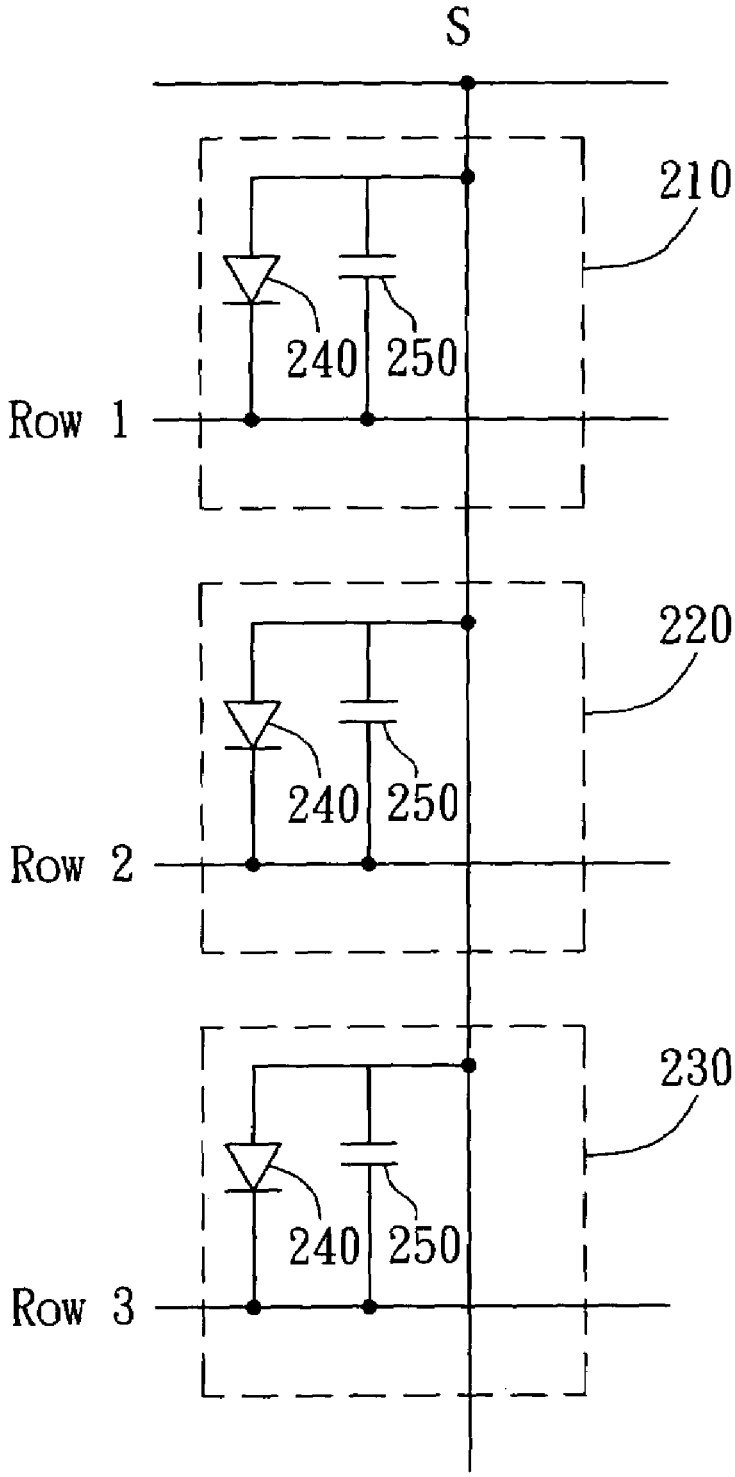
FIG. 2A is a schematic diagram showing only three OLED circuits within one column of the whole OLED array.
Figure 2B:
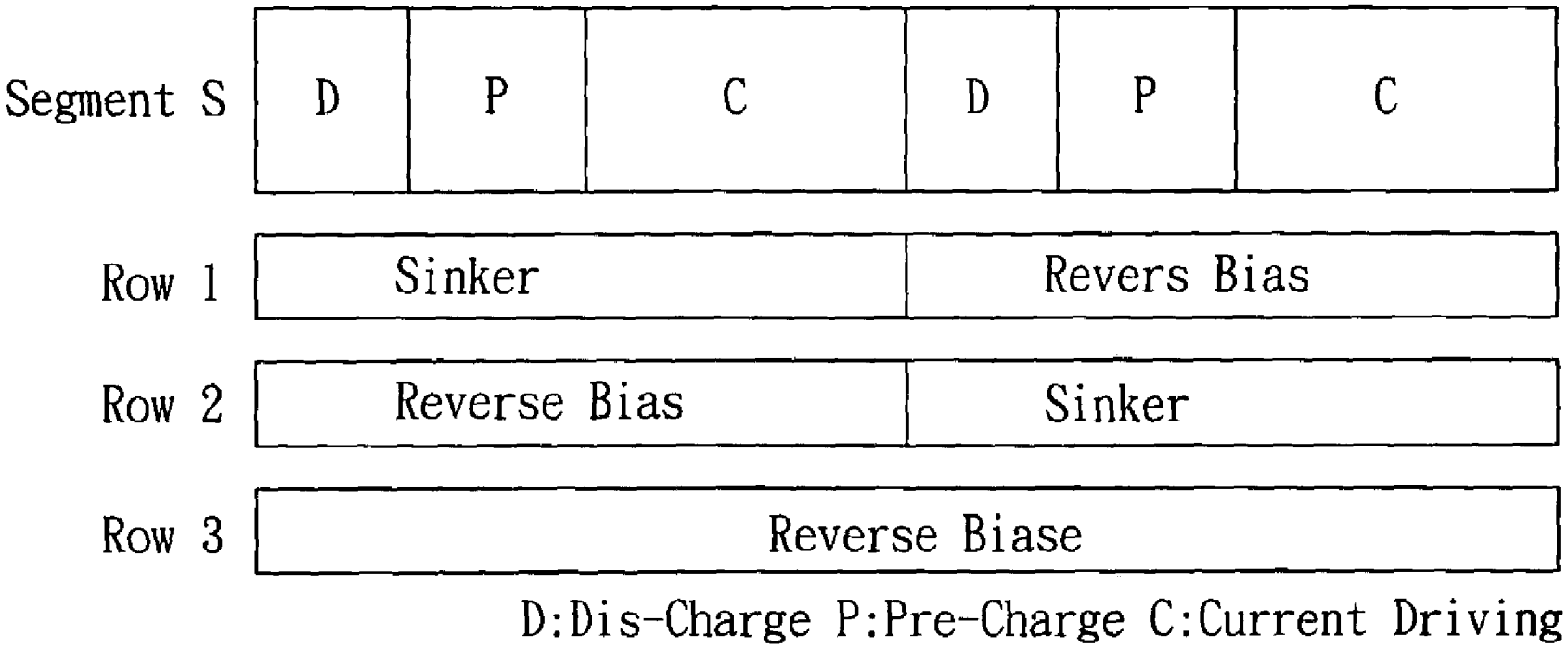
FIG. 2B is a schematic diagram depicting the application of the three-phase driving method on the OLEDs of FIG. 2A.
Figure 3:
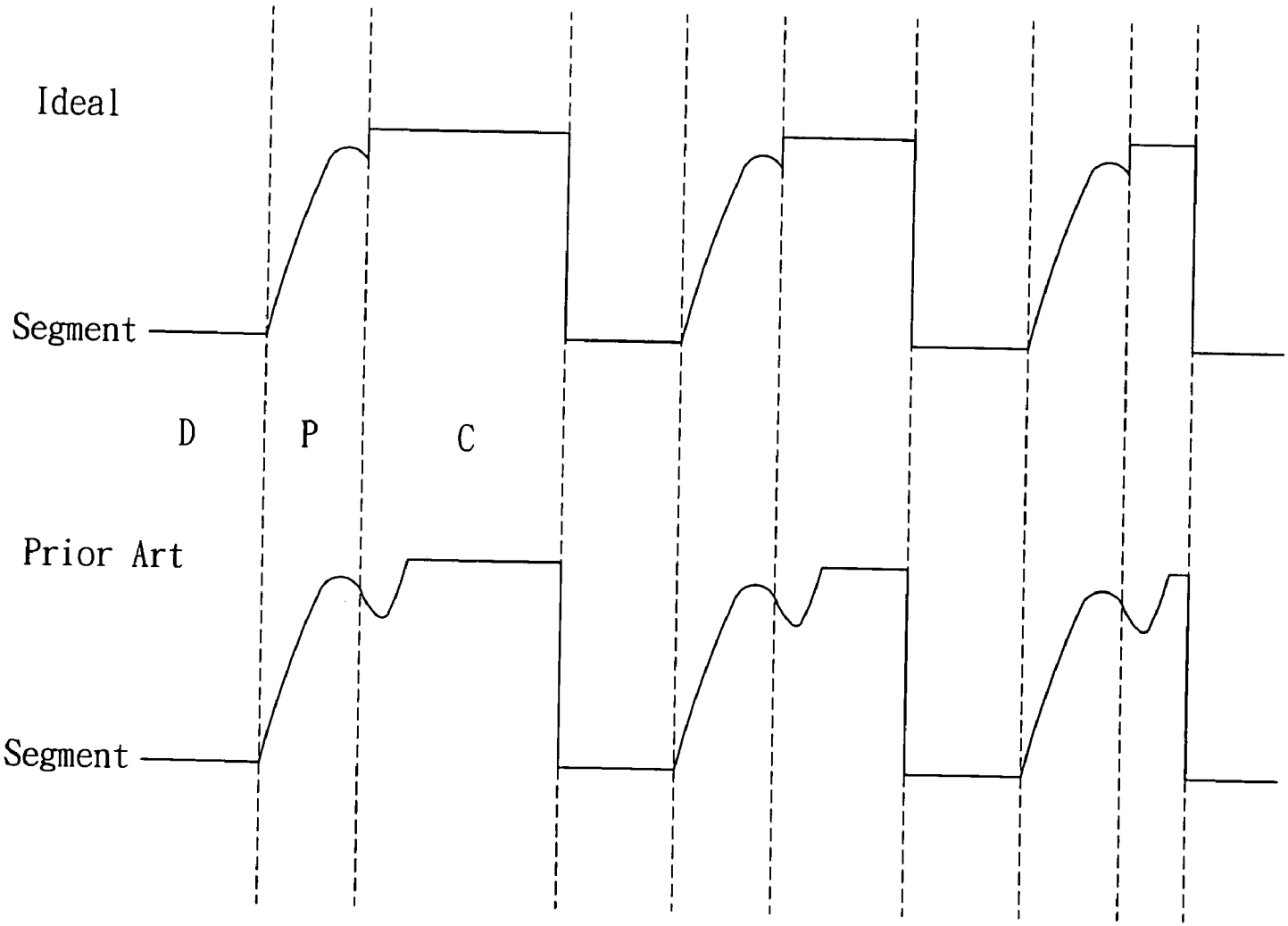
FIG. 3 is a schematic diagram showing the idea and prior-art potentials provided by the conventional three-phase method.
Figure 10:
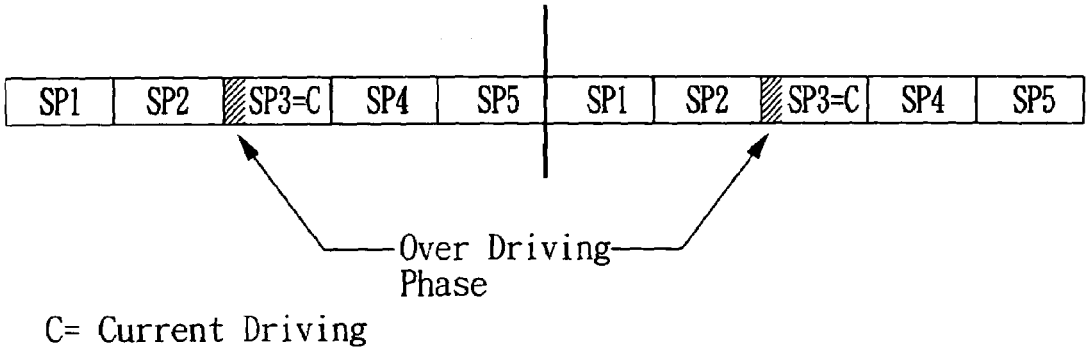
FIG. 10 is a schematic diagram depicting the application of a five-phase driving method on LEDs according to another preferred embodiment of the present invention.

Please refer to FIG. 10, which is a schematic diagram depicting the application of a five-phase driving method on LEDs according to another preferred embodiment of the present invention. As the third phase (i.e. SP3) of the segment of FIG. 10 is defined to be current driving mode, thus, an over driving phase is added just before the third phase in particular so as to provide a current which is short lasting but larger than that of the successive phase of current driving mode, and thus enable the waveform thereof to be more similar to that of the idea condition shown in FIG. 3 by precisely providing the current required for the phase of current driving mode.

Figure 11:
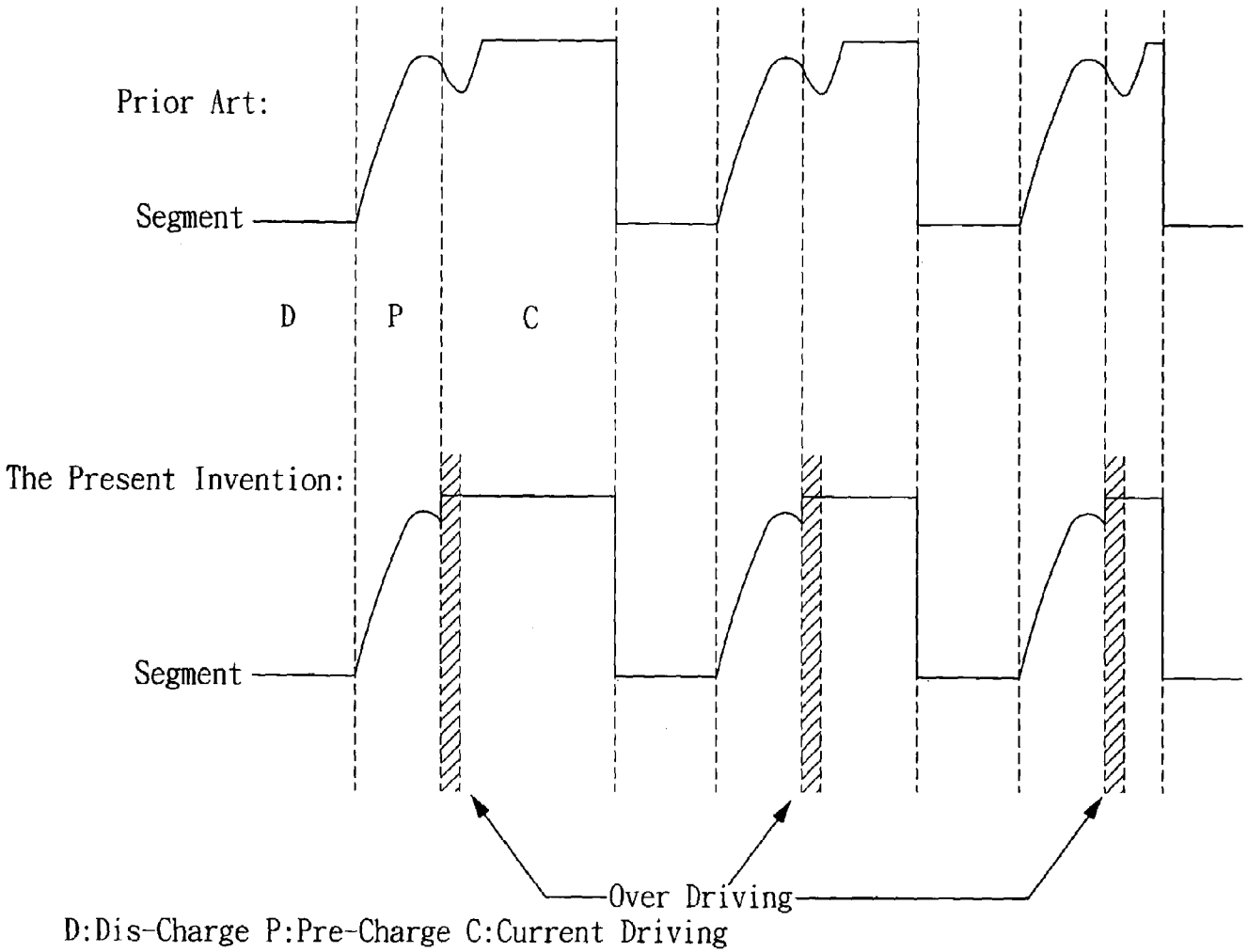
FIG. 11 is an illustration comparing the waveform of the invention with that of prior arts.

Please refer to FIG. 11, which is an illustration comparing the waveform of the invention with that of prior arts. As seen in FIG. 11, a segment with addition over driving phase arranged just before a current driving phase is capable of abrupt raising the potential of the pre-charge phase to an idea level such that the phase of current driving mode can be processes in an idea condition with suffering from the potential drop happening at the end of the pre-charge phase of prior arts.

By virtue of that, the LED driven by the present invention can be lighted at a precise moment and is lighted instantly without the process of from dark to bright as the prior arts.

To sum up, the present invention provides a programmable driving method for light emitting diode, which is capable of providing a programmable multi-phase segment and a corresponding programmable multi-phase actuating signal to an LED with respect to user specification, such that an optimal driving sequence can be provided to the LED according to the requirements of the manufacturing process of a LED display and thus enabling the performance of the gray levels displayed by the LED display to be optimized.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A programmable driving method for light emitting diodes (LEDs), comprising the steps of:

providing potentials of at least three phases with in a segment to a control circuit for controlling the luminescence of an LED;

making an evaluation for selecting an operating mode out of at least three operating modes for each phase with respect to the physical characteristics of the LED; and adjusting the operating time of the operating mode selected for each phase of the segment according to the physical characteristics of the LED.

2. The method of claim 1, wherein the method is capable of providing potentials of five phases.

3. The method of claim 2, wherein each phase has an operating mode selected out of four operating mode.

4. The method of claim 3, wherein the four operating modes are respectively a dis-charge mode, a pre-charge mode, a current driving mode, and a floating mode.

5. A programmable driving method for LEDs, comprising the steps of:

providing an actuating signal of at least three phases to a control circuit for controlling the luminescence of an LED;

making an evaluation for selecting an operating mode out of at least three operating modes for each phase with respect to the physical characteristics of the LED; and adjusting the operating time of the operating mode selected for each phase of the actuating signal according to the physical characteristics of the LED.

6. The method of claim 5, wherein the method is capable of providing an actuating signal of five phases.

7. The method of claim 6, wherein each phase has an operating mode selected out of three operating mode.

8. The method of claim 7, wherein the three operating modes are respectively a current sink mode, a reverse bias mode, and a floating mode.

9. A programmable driving method for LEDs, comprising the steps of:

providing potentials of at least three phases with in a segment to a control circuit for controlling the luminescence of an LED;

providing an actuating signal of at least three phases to a control circuit for controlling the luminescence of an LED with respect to the potentials of the at least three phases;

making an evaluation for selecting an operating mode out of at least three operating modes for each phase of the segment and for selecting an operating mode out of at least three operating modes for each phase of the actuating signal with respect to the physical characteristics of the LED; and adjusting the operating time of the operating mode selected for each phase of the segment and for each phase of the actuating signal according to the physical characteristics of the LED.

10. The method of claim 9, wherein the method is capable of providing potentials of five phases and an actuating signal of five phases.

11. The method of claim 10, wherein each phase of the segment has an operating mode selected out of a dis-charge mode, a pre-charge mode, a current driving mode, and a floating mode, and each phase of the actuating signal has an operating mode selected out of a current sink mode, a reverse bias mode, and a floating mode.

12. The method of claim 11, wherein the selected operating modes of the segment and the actuating signal are applicable to the LED in a region selected from the group consisting of active and non-active.

13. The method of claim 11, wherein a data frame of 16 bits is used for defining the potentials of the phases of the segment, which is also true for the actuating signal.

14. The method of claim 13, wherein the sixth and the seventh bit of the data frame are used for respectively defining the operating modes for each phase of the segment, which is also true for the actuating signal.

15. The method of claim 13, wherein the first 5 bits of the data frame are used for defining the duration of the operating mode for each phase of the segment, which is also true for the actuating signal.

16. The method of claim 11, further comprising the step of:

providing a potential of an over driving phase before applying the potential of the current driving phase.

17. The method of claim 16, wherein the potential of the over driving phase is larger than that of the current driving phase.

* * * * *